US010024060B2

(12) United States Patent
Givens

(10) Patent No.: US 10,024,060 B2
(45) Date of Patent: Jul. 17, 2018

(54) VALLEY FLASHING

(71) Applicant: Robert D. Givens, Tellico Plains, TN (US)

(72) Inventor: Robert D. Givens, Tellico Plains, TN (US)

(73) Assignee: DryFlekt, Inc., Grantham, NH (US)

( * ) Notice: Subject to any disclaimer, the term of this patent is extended or adjusted under 35 U.S.C. 154(b) by 0 days.

(21) Appl. No.: 15/195,322

(22) Filed: Jun. 28, 2016

(65) Prior Publication Data

US 2017/0370104 A1 Dec. 28, 2017

(51) Int. Cl.
*E04D 13/04* (2006.01)
*E04D 1/36* (2006.01)
*E04D 13/064* (2006.01)

(52) U.S. Cl.
CPC ..... *E04D 13/0445* (2013.01); *E04D 1/36* (2013.01); *E04D 13/064* (2013.01); *E04D 2013/0454* (2013.01)

(58) Field of Classification Search
CPC ..... E04D 1/36; E04D 3/40; E04D 13/0445; E04D 2013/0454; E04D 13/064
USPC ..... 52/13
See application file for complete search history.

(56) References Cited

U.S. PATENT DOCUMENTS 403,750 A * 5/1889 Hamsley ..... E04D 13/064 52/13
616,781 A * 12/1898 Garland ..... E04D 13/064 52/14
749,972 A * 1/1904 Simpson ..... E04D 13/064 52/13
2,258,078 A * 10/1941 Tennison ..... E04D 13/0445 52/13
3,352,649 A 11/1967 Tennison, Jr.
3,411,259 A 11/1968 Anderson et al.
4,489,532 A * 12/1984 Ellis ..... E04D 1/30 52/13
5,115,603 A 5/1992 Blair
5,619,827 A 4/1997 Church
6,912,813 B2 7/2005 Grizenko
2003/0000157 A1* 1/2003 Austin ..... E04D 1/36 52/95
2003/0159365 A1* 8/2003 Hutton ..... E04D 1/36 52/13
2004/0110982 A1 6/2004 Anderson et al.
2011/0083375 A1 4/2011 Tenute
2011/0277391 A1* 11/2011 Skoretz ..... E04D 13/0445 52/13
2014/0326837 A1 11/2014 Rumsey et al.

FOREIGN PATENT DOCUMENTS

AT 111690 B 12/1928
AU 706184 B3 6/1999
AU 782887 B2 9/2005
(Continued)

*Primary Examiner* — Adriana Figueroa
*Assistant Examiner* — Jessie T Fonseca
(74) *Attorney, Agent, or Firm* — St. Onge Steward Johnston & Reens, LLC

(57) ABSTRACT

A valley flashing including two roof panels adapted to protect a roof valley. Some embodiments include one or more attachment flanges joined to the roof panels. Some embodiments include one or more protrusions for protection from water infiltration under roof shingles.

18 Claims, 7 Drawing Sheets

(56) References Cited

FOREIGN PATENT DOCUMENTS

| | | | | | |
|---|---|---|---|---|---|
| CA | 2153732 | A1 | | 1/1997 | |
| DE | 3511089 | A1 | | 4/1986 | |
| DE | 19627750 | A1 | * | 1/1997 | ..... E04D 1/36 |
| EP | 0853170 | A2 | | 7/1998 | |
| FR | 2904017 | A1 | * | 1/2008 | ..... E04D 1/36 |
| FR | 2956678 | A1 | | 8/2011 | |
| GB | 2388867 | A | | 11/2003 | |
| WO | 9426997 | A1 | | 11/1994 | |
| WO | 0153625 | A1 | | 7/2001 | |

* cited by examiner

VALLEY FLASHING

The present invention is directed to a flashing for use on a roof valley.

BACKGROUND OF THE INVENTION

Many buildings include multiple roof sections that are at angles with respect to each other and that intersect. The joint at which two roof sections intersect at a peak or point is often referred to as the roof "ridge." The concave joint between two roof sections is often referred to as a valley. Roof valleys typically encounter high water loads because the valley collects water running off of two roof sections.

The roof sections are typically covered by a plurality of shingles, and on many roofs, a valley flashing component is installed at the valley joint where the use of shingles is not a practical option. The valley flashing runs along the valley joint and shingles are layered on top of it. The purpose of the valley flashing is to provide increased protection against water infiltration at the valley joint. Without proper sealing of the valley joint, water can seep underneath the roof shingles and cause rot and deterioration of the roof decking and rafters.

Traditional valley flashing designs suffer from notable drawbacks. First, in geographical areas in which stormy, windy weather is common, water can be forced far enough under the shingles that are layered over the edge of the valley flashing and can then reach the roof material under the shingles and flashing. High winds, which are often accompanied by rain, can lift parts of the shingles and allow blown rain to move between the shingles and the flashing.

Next, valley flashing is often made of metal, which can act as a lightning rod. The metal valley flashing can attract lightning, which, when it occurs, can destroy the structure to which the flashing is attached. Metal flashing also presents difficulties in joining multiple pieces to cover a long valley joint. Joining a number of individual flashing components together to cover a valley joint are typically requires sealing with caulk, for example, silicone caulk. Caulked joint seals have a limited lifespan before they degrade and cause the seal to fail. Seal failure requires expensive repair or it can cause water leaks and, eventually, rot.

Traditional valley flashing is typically installed by applying a fastener, such as a nail, directly through the flashing itself and into the roof decking. This has some notable disadvantages. First, it creates an opening through the flashing through which water can reach the roof decking. Second, it eliminates the ability of the installer to make adjustments to the positioning of the flashing as he or she is installing the shingles over the edge of the flashing.

Accordingly, what is desired is valley flashing that provides improved protection of a roof valley joint from water intrusion, particularly in geographical areas subject to intense storms. Further, what is desired is a valley flashing that is resistant to degradation over time. Even further, what is desired is a valley flashing that is easier and less cost intensive to manufacture, install, and maintain.

SUMMARY OF THE INVENTION

It is an object of the present invention to provide improved protection of a roof valley joint from water intrusion.

It is a further object of the present invention to provide a valley flashing device that is resistant to degradation over time, even when it is exposed to elements such as wind, rain, and sunlight.

It is yet a further object of the present invention to provide a valley flashing that is easier and less cost intensive to manufacture, install, and maintain.

According to a first embodiment of the present invention, a roof valley flashing device is provided, comprising: a first roof panel comprising a first upper surface and a first lower surface; a second roof panel arranged at a first angle with respect to said first panel and comprising a second upper surface and a second lower surface; and a first attachment flange extending from the first lower surface of the first roof panel.

In some embodiments, the device further comprises a second attachment flange extending from the second lower surface of the second roof panel. In some embodiments, the device further comprises a longitudinal axis; and a first protrusion having substantially the shape of a "T" when viewed along the longitudinal axis, and arranged on the first upper surface. In some embodiments, the device further comprises a second protrusion having substantially the shape of a "T" when viewed along the longitudinal axis, and arranged on the second upper surface.

In some embodiments, the device further comprises a third protrusion arranged on the first upper surface, the third protrusion extending at an angle toward a center of the device. In some embodiments, the device further comprises a fourth protrusion arranged on the second upper surface, the fourth protrusion extending at an angle toward the center of the device. In some embodiments, the device further comprises a middle portion that connects the first roof panel and the second roof panel.

In some embodiments, the middle portion is shaped and the first and second roof panels are arranged such that the device has substantially the shape of a "W" when viewed along the longitudinal axis. In some embodiments, each of the first and second roof panels are joined to the middle portion by a curved corner. In some embodiments, the third protrusion is disposed on the first upper surface between the first protrusion and the middle portion, and the fourth protrusion is disposed on the second upper surface between the second protrusion and the middle portion.

In some embodiments, the device further comprises a fifth protrusion arranged on the first upper surface adjacent to the third protrusion and extending at an angle toward the center of the device; and a sixth protrusion arranged on the second upper surface adjacent to the fourth protrusion and extending at an angle toward the center of the device.

In some embodiments, the first roof panel further comprises a first upper edge and a first lower edge and the second roof panel further comprises a second upper edge and a second lower edge; and the first attachment flange extends from the first lower surface at the first lower edge and the second attachment flange extends from the second lower surface at the second lower edge.

In some embodiments, the device is comprised of a flexible, plastic material. In some embodiments, the device is formed by an extrusion process.

According to a second embodiment of the present invention, a roof valley flashing device is provided, comprising: a longitudinal axis, a first roof panel comprising a first upper surface, a first upper edge, and a first lower edge; a second roof panel arranged at a first angle with respect to said first panel, and comprising a second upper surface, a second upper edge, and a second lower edge; a middle portion connected to the first lower edge and to the second lower edge; a first protrusion having substantially the shape of a "T" when viewed along the longitudinal axis, and arranged on the second upper surface; and a second protrusion having substantially the shape of a "T" when viewed along the longitudinal axis, and arranged on the second upper surface. The first protrusion is located between the first upper edge and the first lower edge of the first roof panel and the second protrusion is located between the second upper edge and the second lower edge of the second roof panel.

In some embodiments, the device further comprises a first attachment flange extending from the first lower surface of the first roof panel and a second attachment flange extending from the second lower surface of the second roof panel. In some embodiments, the device further comprises third and fourth protrusions disposed on the first upper surface between the first protrusion and the first lower edge, the third and fourth protrusions extending toward a center of the device. In some embodiments, the device further comprises fifth and sixth protrusions disposed on the second upper surface between the second protrusion and the second lower edge, the fifth and sixth protrusions extending toward the center of the device.

According to a third embodiment of the present invention, a roof valley flashing device is provided, comprising: a longitudinal axis, a first roof panel extending along the longitudinal axis and comprising a first upper surface, a first upper edge, and a first lower edge; a second roof panel extending along the longitudinal axis and arranged at a first angle with respect to said first panel, and comprising a second upper surface, a second upper edge, and a second lower edge; a middle portion connected to the first lower edge and to the second lower edge; at least one first tab disposed on the first roof panel, extending substantially parallel to the longitudinal axis and angled toward a center of the device; and at least one second tab disposed on the second roof panel, extending substantially parallel to the longitudinal axis and angled toward the center of the device.

In some embodiments, the middle portion is shaped and the first and second roof panels are arranged such that the device has substantially the shape of a "W" when viewed along the longitudinal axis. In some embodiments, the device further comprises a first attachment flange extending from the first lower surface of the first roof panel and a second attachment flange extending from the second lower surface of the second roof panel.

In some embodiments, the device further comprises a first protrusion having substantially the shape of a "T" when viewed along the longitudinal axis and arranged on the second upper surface; a second protrusion having substantially the shape of a "T" when viewed along the longitudinal axis, and arranged on the second upper surface; and the first protrusion is located between the first upper edge and the first lower edge of the first roof panel and the second protrusion is located between the second upper edge and the second lower edge of the second roof panel.

Exemplary embodiment(s) of the invention will now be described in greater detail in connection with the following drawings.

DETAILED DESCRIPTION OF THE INVENTION

The figures show certain embodiments of the present invention having a variety of features. It will be understood by those of skill in the art that not all of the features of each embodiment depicted or described are necessarily present in other possible embodiments of the invention.

Figure 1:
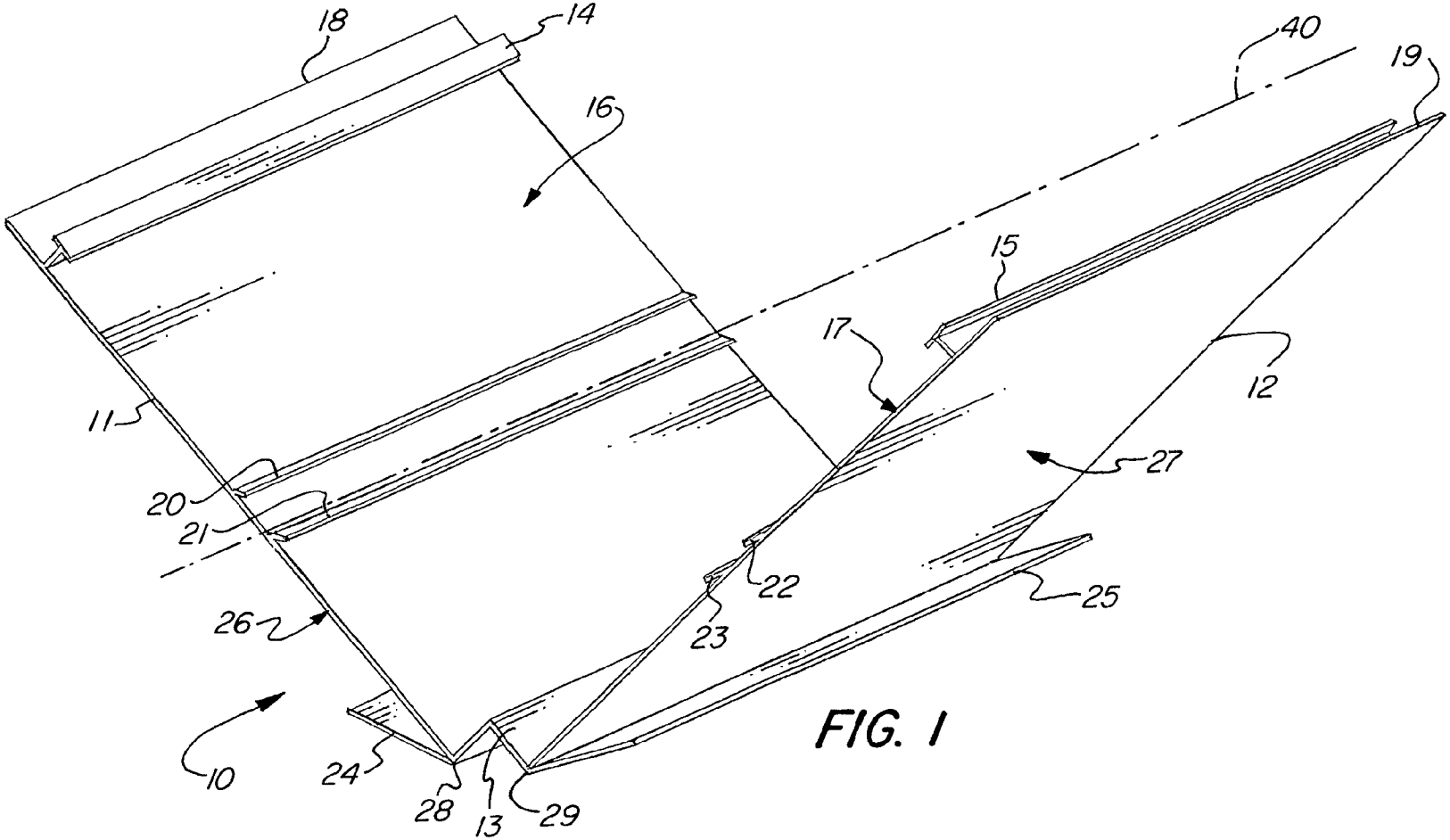
FIG. 1 is a perspective view of a valley flashing according to a first embodiment of the present invention.

FIG. 1 shows a valley flashing device 10 according to a first embodiment of the present invention. The valley flashing 10 includes two main panels: a first roof panel 11 and a second roof panel 12. The roof panels 11 and 12 are positioned at an angle relative to one another. The roof panels 11 and 12 are joined together by a middle portion 13. In the embodiment shown in FIG. 1, the middle portion 13 is shaped like an up-side-down "V" so that the overall shape of the valley flashing is substantially the shape of a "W".

Figure 2:
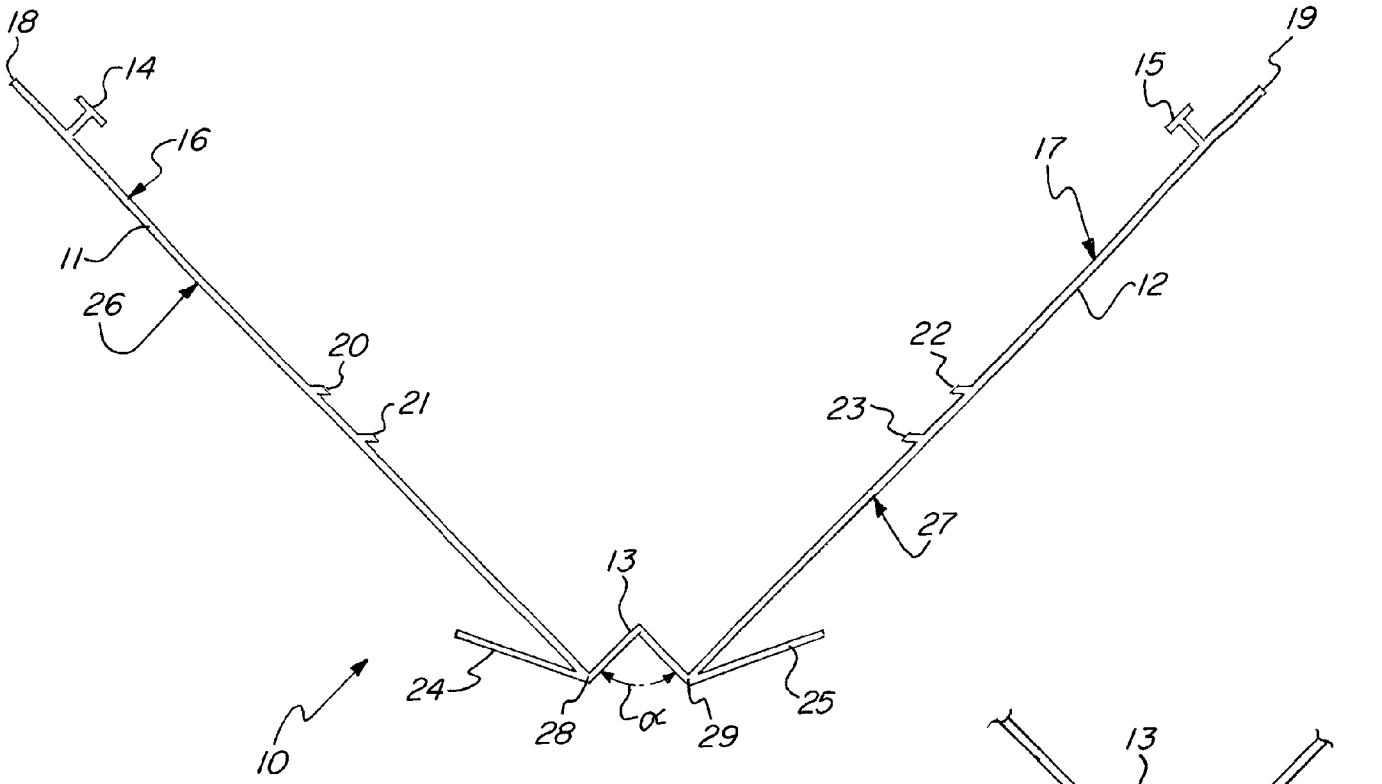
FIG. 2 is a side view of the valley flashing shown in FIG. 1.

The valley flashing 10 shown in FIG. 1 includes two "T" protrusions 14 and 15, one on each of the upper surface 16/17 of each roof panel 11 and 12. The "T" protrusions are disposed near the upper edges 18 and 19 of the roof panels. The "T" protrusions are referred to as such because they have substantially the shape of the letter T when viewed along the longitudinal axis 40 of the flashing 10. This view is shown in FIG. 2. In other embodiments, the "T" protrusion has different shape in other embodiments, such as "T" "ᒣ" "ᒣ" "ᒣ" "ᒣ" "π" "ᒣ", "ᒣ", "Y", and "ᒣ".

The valley flashing 10 also includes two sets of wind tab protrusions. Wind tab protrusions 20 and 21 are disposed on the upper surface 16 of the first roof panel 11, while wind tab protrusions 22 and 23 are disposed on the upper surface 17 of the second roof panel 12.

The valley flashing 10 shown in FIG. 1 also includes two attachment flanges 24 and 25. The attachment flanges 24 and 25 are attached to the lower surfaces 26 and 27 of the first and second roof panels 11 and 12, respectively. In this embodiment, the flanges 24 and 25 are attached at the lower edges 28 and 29 of the first and second roof panels. The attachment flanges 24 and 25 are adapted to receive a fastener of some kind in order to secure the valley flashing 10 to a roof. Appropriate fasteners include nails, staples, screws, and the like. The fastener is used by driving it through the attachment flange and into the roof (such as the roof decking). In this way, the valley flashing is secured to the roof. Other embodiments include only a single attachment flange, such as one or the other of flanges 24 and 25. Still other embodiments do not include any attachment flanges.

FIG. 2 shows an alternative view of the valley flashing 10 in which the positioning of its components is more apparent. In this embodiment, the roof panels 11 and 12 are positioned at about a 90 degree angle with respect to each other. This angle is designated by reference character "a". In other embodiments, the roof panels are arranged at alternative angles with respect to each other, which is accomplished by varying one or more of the angles in the middle portion 13.

The "T" protrusions 14 and 15 are positioned approximately 1 inch away from the upper edges 18 and 19 of the roof panels. The wind tabs 20, 21, 22, 23 are positioned roughly halfway between the upper edges 18 and 19 and the lower edges 28 and 29 of the roof panels. In this particular embodiment, the lower wind tabs 21 and 23 are approximately 5 inches from the lower edges 28, 29, and the upper wind tabs 20 and 22 are approximately six inches from the lower edges 28, 29. In this embodiment, each roof panel 11 and 12 is approximately 12 inches wide, i.e., the lower edge 28/29 is approximately 12 inches from the upper edge 18/19. The flashing 10, in this embodiment, is approximately 3/32nds of an inch thick.

Figure 7:
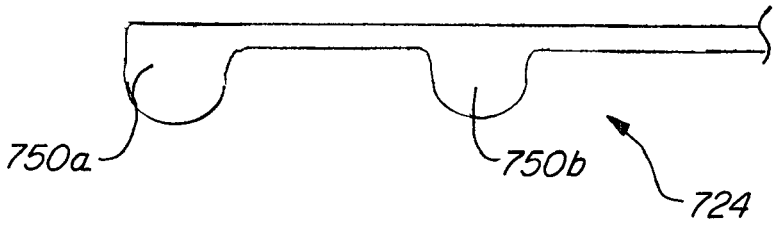
FIG. 7 is a perspective view of a portion of a valley flashing according to a fifth embodiment of the present invention.

FIG. 2 also shows the positioning of the attachment flanges 24 and 25. The flanges are joined to the lower surfaces 26, 27 at the lower edges 28, 29 of the roof panels 11 and 12. In this embodiment, the flanges are about two inches wide. In the embodiment shown, the flanges 24 are substantially rectangular features that extend essentially parallel to the longitudinal axis of the flashing. The flanges take a variety of shapes in other embodiments, such as a series of spaced protrusions each for receiving a fastener. This can be in the form of a sawtooth flange having triangular, rectangular, or rounded teeth, the teeth spaced appropriately so that each tooth could receive a fastener. An example of such a design for the attachment flanges is shown in FIG. 7. The flange 724 includes to protrusions 750*a* and 750*b* joined by narrower portions of the flange. The flange 724 is still substantially planar, but requires far less material than a strictly rectangular flange such as those shown in FIG. 1.

Figure 2A:
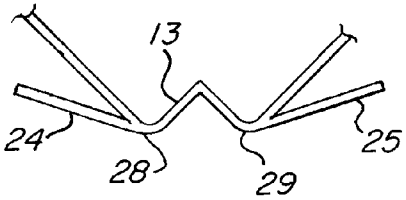
FIG. 2*a* is a side view of an alternate embodiment of the valley flashing shown in FIGS. 1 and 2.

In the embodiment of FIG. 2, the three corners of the "W" are relatively sharp corners. In other embodiments, one or more of these corners are curved instead of sharp. Such an embodiment is shown in FIG. 2*a*, in which the lower edges 28 and 29 are curves. In that embodiment, the radii of the curves is approximately ⅛". In other, similar embodiments the radii is approximately ¼", ⅓", and ½". The curved lower corners are better able to accommodate welding tools necessary to join two flashing pieces together.

Figure 3:
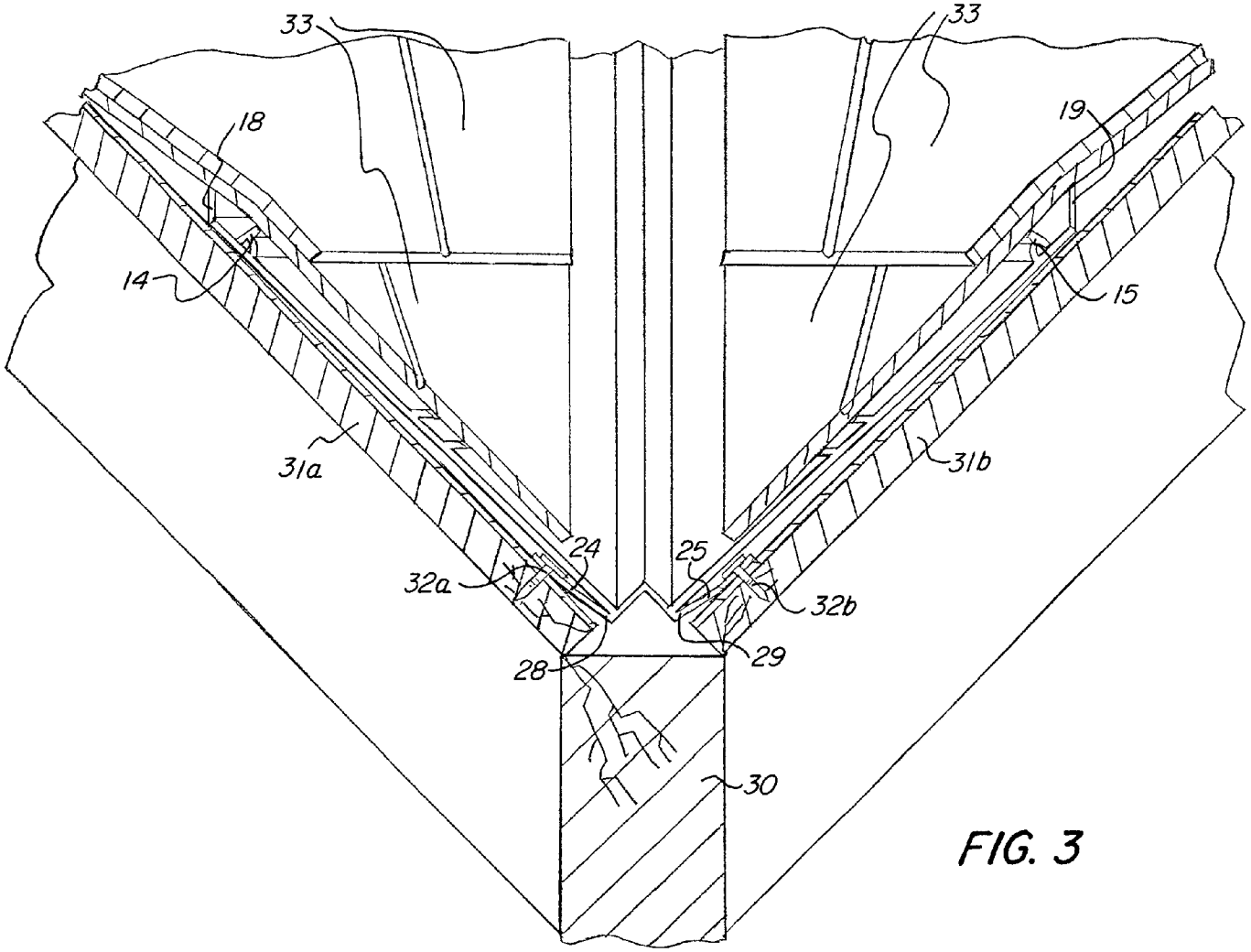
FIG. 3 is a side cross-section view of the valley flashing shown in FIG. 1 that is installed at a roof valley and shown with other building components installed.

FIG. 3 shows a cross section view of the valley flashing 10 installed in a roof valley joint. The valley rafter 30 is shown, along with roof decking 31*a* and 31*b*. The flashing 10 is installed on top of those components. Nails 32*a* and 32*b* are shown driven through the attachment flanges 28 and 29 and into the roof decking 31*a* and 31*b*. Shingles 33 are shown installed over the upper edges 19 and 19 of the flashing. Because the flashing 10 is constructed of a flexible material, the installation of the shingles causes the "T" protrusions to flex underneath the shingles. These protrusions create a tight seal between the shingles and flashing to prevent water from reaching the roof decking. In some installations, the "T" protrusions flex upwardly toward the upper edges 18 and 19 (as shown in FIG. 3), but in other installations, the "T" protrusions are bent in the other direction: downwardly toward the lower edges 28 and 29.

The wind tabs 20, 21, 22, and 23 are designed to be disposed under the roof shingles 33. In the embodiment shown, the tabs are flexible, so that they bend downward toward the surface of the roof panels when the shingles are installed on top of the tabs. In some embodiments, the flashing 10 has only a single wind tab in or around the position of the tabs 20, 21, 22, and 23 shown in the Figures. The wind tabs help prevent water from migrating up and under the shingles. This protects the roof decking 31*a* and 31*b* from water damage. In the embodiment shown, the wind tabs project from the upper surfaces 16 and 17 at angles other than 90 degrees. Advantageously, the tabs are arranged at an angle such that they point toward the center of the flashing. For example, tabs 20 and 21 are angled with respect to the upper surface 16 such that they extend toward the middle of the flashing. This feature that the tabs are angled toward the middle of the flashing is achievable using a variety of angles. These include angles less than 90 degrees as shown in the figures, 90 degrees, and even greater than 90 degrees, so long as the extension of the tab is in the direction of the center of the flashing. In the particularly advantageous embodiment shown, the tabs are angled toward the opposite roof panel, which requires a more acute angle than a tab that extends only toward the center of the flashing.

In the embodiment shown in FIGS. 1, 2, and 3, the wind tabs protrude from the upper surfaces of the roof panels such that they are angled toward the opposite roof panel. In other words, wind tabs 20 and 21, which protrude from roof panel 11, are angled toward the opposite roof panel 12. This arrangement provides an ideal balance between the wind tabs being flexible and sufficiently compressible under the roof shingles and also providing an effective seal against wind-driven water. Further, in the embodiment shown, the wind tabs are substantially linear features in that they extend essentially along and essentially parallel to the longitudinal axis of the flashing. In the embodiment shown, the tabs are also substantially planar features, in that two of their dimensions are substantially larger than their third dimension. In other embodiments, the tabs include undulations along their length such that they are not strictly planar.

In some embodiments, the flashing 10 is secured to the roof by attachment fasteners through the flanges 24 and 25 and then nails are used to secure the shingles 33, some of which are also driven through the flashing 10. In such embodiments, then, only the nails through the flanges 24 and 25 secure the flashing alone. In other embodiments, additional fasteners driven through the roof panels 11 and 12 are used to secure the flashing 10 to the roof. This is not always the optimal installation process, however, as it requires more fasteners than other techniques.

In the embodiment shown, the valley flashing 10 is formed of a flexible, resilient material. Material of this type permits the "T" protrusions and wind tabs to flex underneath the shingles and provide a seal. In the embodiment of the invention shown in the figures, the flashing 10 is constructed of a polymer plastic material. The flashing, including the roof panels, middle portion, and protrusions, is a single unitary piece. In an advantageous embodiment, the flashing is extruded by a melt extrusion process. As is known in the art, such a process generally involves melting raw plastic pellets and forcing the melted plastic through a die. The extrusion product is then cooled so that it hardens into the shape created by the die. Flashing made by this method can be made into virtually any desirable length. Other suitable manufacturing processes are employed in other embodiments, such as injection molding.

The material used in the most advantageous embodiments of the present invention is flexible and completely waterproof. The most advantageous polymers for this application do not degrade significantly with time. Such advantageous polymers include additives to increase the material's resistance to breakdown due to exposure to ultraviolet (UV) light.

In the advantageous embodiment shown in the figures, the flashing is constructed using a polypropylene-based composition in the thermoplastic elastomer olefinic chemical family. The composition includes polypropylene, a styrene ethylene butylene styrene copolymer, calcium carbonate, antioxidant/stabilizer, and mineral oil. A colorant is also added to provide the desired appearance of the flashing and to enhance the UV breakdown resistance of the flashing. Pigments and other fillers are generally encapsulated in the resin so as to avoid any hazardous conditions when the material is processed.

The embodiment of the flashing shown in the figures is made using a material that will not show evidence of visible cracks after exposure to ozone pressure of 100 mPa and a temperature of 104° F. for 70 hours, pursuant to ASTM Standard D1149-12. Further, the material used in the embodiment of the figures will not show appreciable change in mass or volume after submersion in distilled water at a temperature of 158° F.±2° F. for a minimum of 46 hours, pursuant to ASTM Standard D471-06. Specifically, the material will have a percent change in mass and volume of about 0.00%, respectively.

The material used in the embodiment of the figures also meets the AC286 Section 4.4 standard using the ASTM Standard D412-06 tensile strength and elongation procedure even after weathering for 2000 hours in accordance with ASTM G154. Specifically, the average ultimate elongation of the weathered material exceeds the minimum of 210 percent under SC286 Section 4.4 and the minimum of 85 percent under AC286 Section 4.7 with respect to control specimens. Even more specifically, the material has an average tensile strength of 1530 psi before weathering and an average tensile strength of 1490 psi post-weathering. The material has an average elongation percent of 472% before weathering and 427% post weathering.

The tear strength of the material used in the embodiment of the figures exceeds the minimum of 1.43 pounds per inch pursuant to AC286 Section 4.5 and ASTM Standard D624-12. Specifically, the material has an average tear strength of 733 pounds per inch.

The material used in the embodiment of the figures does not show signs of cracking or brittleness when tested at −40° C. in accordance with AC286 Section 4.6 and ASTM Standard D2137-11. Furthermore, the material meets the tensile strength and elongation requirements of AC286 Section 4.7 even after exposure to Ultra Violet radiation pursuant to ASTM Standard G154-06. In other words, its average ultimate elongation percent exceeds 85% of the average elongation percent of the control specimens.

Advantageously, the material of the embodiment of the flashing shown in the figures is selected to expand and contract in concert with the expansion and contraction of the other building materials around the flashing, such as the roof decking, rafters, shingles, siding, etc. This minimizes the effects of such expansion and contraction on the seals between sections of flashing and the overall strength of the flashing.

A further advantage of embodiments of the present invention that are formed of the above-described polypropylene-based composition is that the flashing does not conduct electricity like traditional, metal flashing. Traditional metal flashing can attract lightning due to its conductivity. Embodiments of the present invention that are formed of certain polymer plastic materials, such as the above-described polypropylene-based composition, have negligible conductivity. The result is that roofs that use such embodiments of the present invention instead of metal flashing are far more resistant to lightning strikes or other electrical damage.

Another advantage of this embodiment of the present invention is that a single piece of flashing can be used along an entire length of the valley joint even as the length exceeds multiple feet. As a result of its construction using a polymer and the extrusion technique, the flashing can be made in a much greater length than traditional flashing. As such, the flashing of this embodiment of the present invention requires far fewer joints between pieces of flashing. When a joint is required, the two pieces of flashing can be joined by the technique of heat welding using a piece of polymer of the same or similar composition. This heat-welded joint remains strong and watertight much longer than a caulked joint between metal flashings. The heat-welded joints require less maintenance and have a much lower risk of failure than traditional caulked joints. As those of skill in the art will appreciate, caulking is an inexact science. Once caulk loses its adhesion to a surface, it can act as a siphon and draw water in. For some installations, some portions of the protrusions on the flashing 10 (such as the "T" protrusions and wind tabs) are trimmed by the installer to permit two pieces of the flashing to overlap and be welded together. In other embodiments, two sections of overlapping flashing can be joined in a permanent, bonded relationship using an approved sealant. Such a sealant may fuse the two sections together permanently as if they had become a single, continuous section.

The flexibility of the flashing according to the exemplary embodiments shown in the figures also improves the ease and quality of the installation. The flexible flashing is better able to adapt to variations in the roof decking and rafters. This improves the waterproofing function of the valley flashing.

It will also be understood that patching or repairing the flashing of the illustrated embodiments of the present invention is much easier and less expensive than with traditional flashing. Should a crack or hole form in the flashing of the present invention, it is relatively straight forward to apply a heat weld patch directly to the affected area. Such a repair will provide a consistent surface and will be long-lasting.

Figure 4:
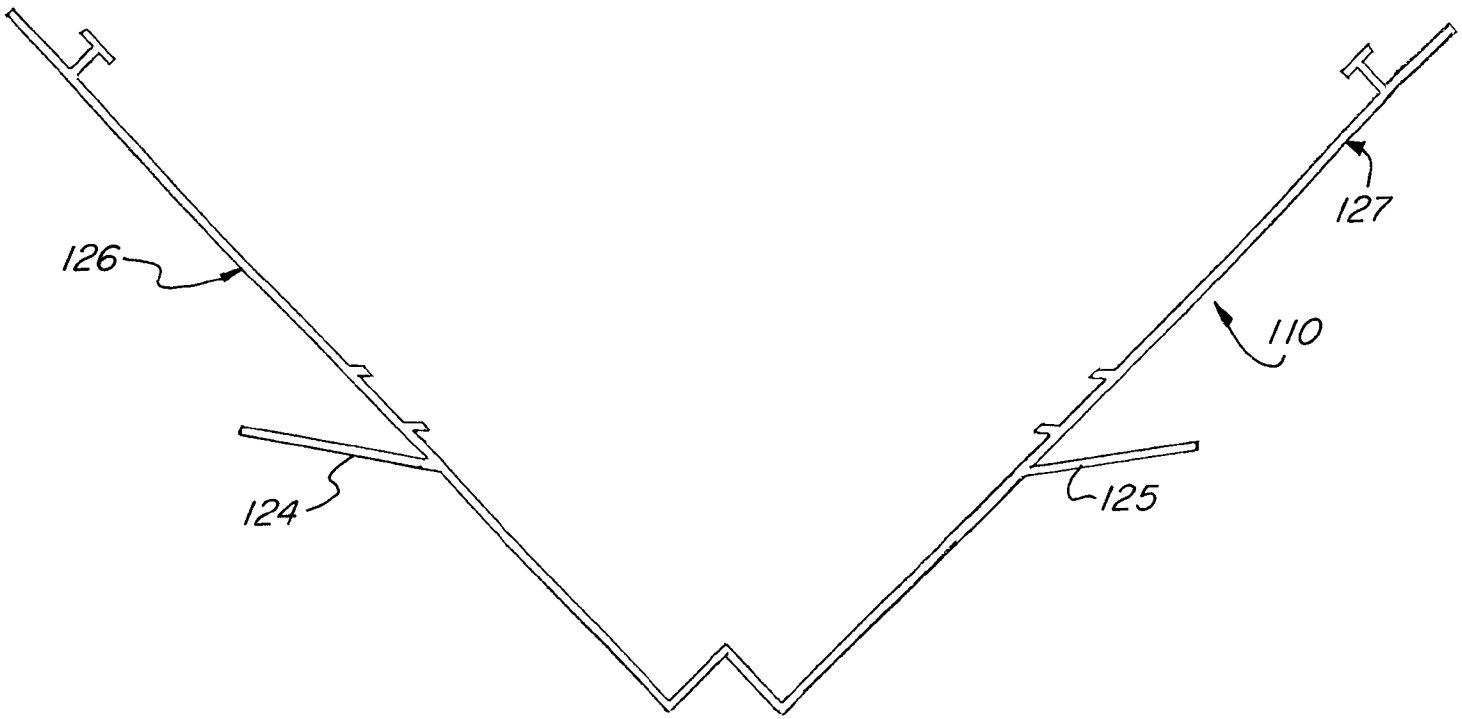
FIG. 4 is a side view of a valley flashing according to a second embodiment of the present invention.

FIG. 4 shows an alternative embodiment of the present invention. In this embodiment, flashing 210 has attachment flanges 224 and 225 disposed nearer to the center of the lower surfaces 226 and 227. In other embodiments, the attachment flanges are disposed at other locations on the lower surfaces of the roof panels of the flashing according to the manufacturer's and/or installer's preference.

Figure 5:
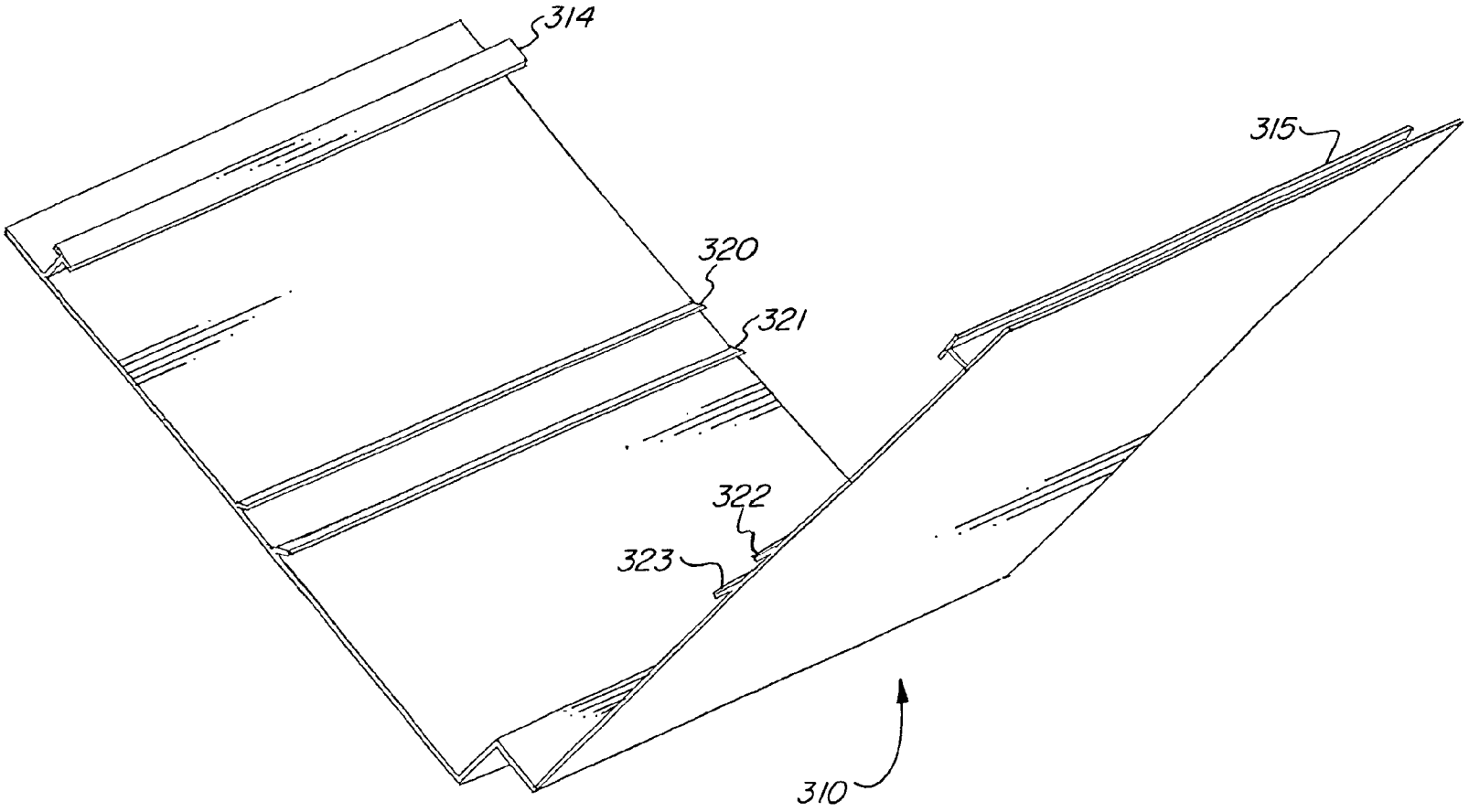
FIG. 5 is a perspective view of a valley flashing according to a third embodiment of the present invention.

FIG. 5 shows a third embodiment of the invention in the form of flashing 310. The flashing 310 of this embodiment does not include an attachment flange. The flashing 310 does include, however, "T" protrusions 314 and 315 and wind tabs 320, 321, 322, and 323. As in previously described embodiments, the corners of the flashing that form the "W" in the embodiments shown in FIGS. 4 and 5 are in some embodiments formed as curves having a radius instead of a sharp corner. These radii range from ⅛", ¼", ⅓", to ½" depending on the embodiment.

Figure 6:
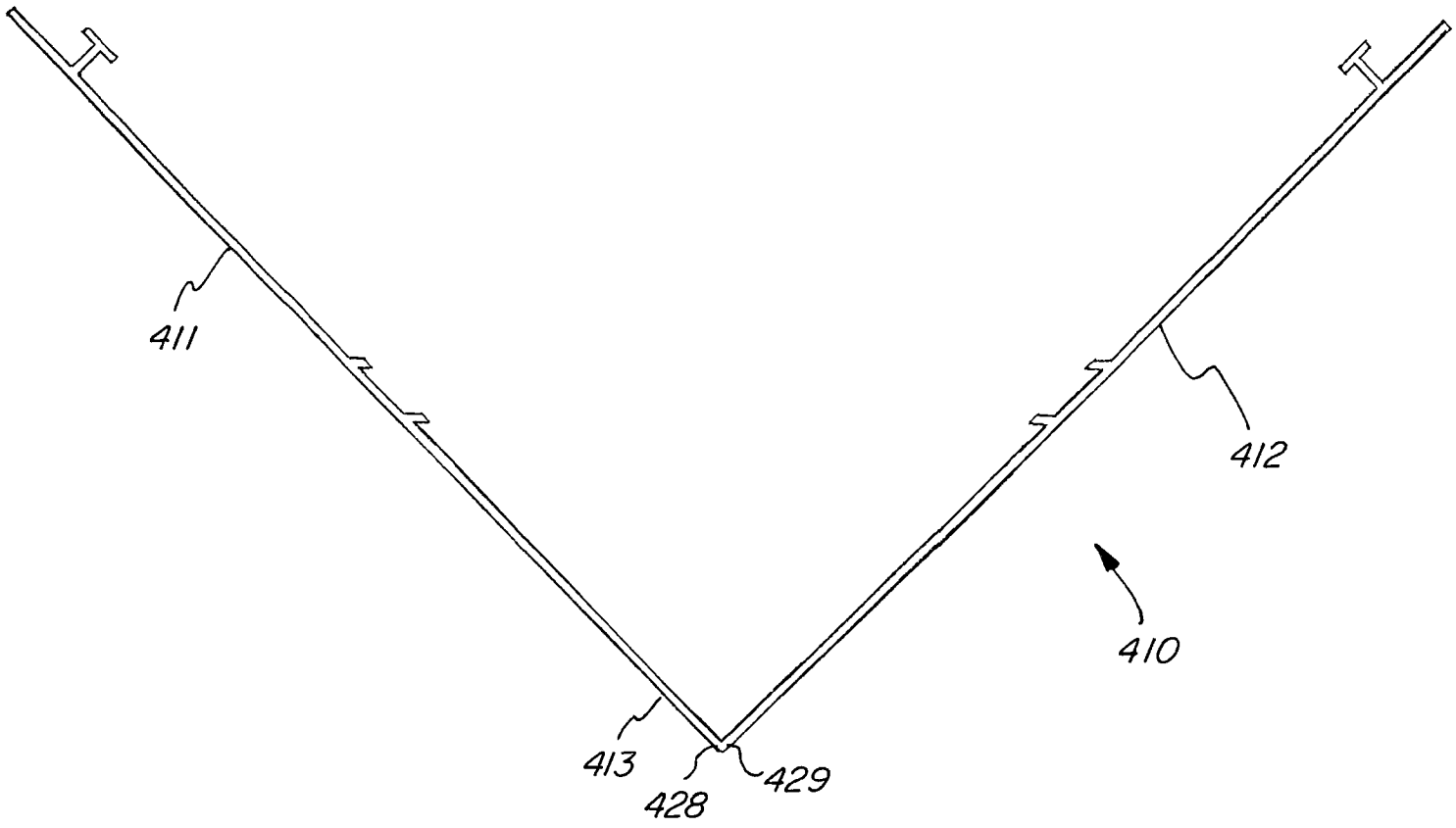
FIG. 6 is a side view of a valley flashing according to a fourth embodiment of the present invention.

FIG. 6 shows a fourth embodiment of the invention in the form of flashing 410. In this embodiment, the middle portion 413 is not an inverted "V" (relative to the roof panels 411 and 412) as in the first embodiment, but rather, is a right-side-up "V". As such, the overall cross section of the flashing 410 has the shape of a "V". In this embodiments, the lower edges 428 and 429 of the roof panels are joined to one another. In other embodiments, the flashing has substantially the shape of a "V" and also includes attachment flanges extending from either the lower edges 428/429, or elsewhere on the lower surfaces of the flashing. Again, the corner of the "V" is a sharp corner is some embodiments as shown in FIG.

6, but in other embodiments it is a curve having a radius. This permits easier access for tools used to weld two flashing pieces together.

While this invention has been described in specific terms related to an exemplary embodiment or embodiments, it will be understood by those of skill in the art that modifications may be made in the configurations and dimensions of those embodiment(s) without departing from the following claims.

What is claimed is:

1. A roof valley flashing device, comprising:
a longitudinal axis;
a first roof panel comprising a first upper surface and a first lower surface;
a second roof panel arranged at a first angle with respect to said first panel and comprising a second upper surface and a second lower surface;
a middle portion that connects the first roof panel and the second roof panel;
a first attachment flange extending from the first lower surface of the first roof panel;
a second attachment flange extending from the second lower surface of the second roof panel; and
a first protrusion having substantially the shape of a "T" when viewed along the longitudinal axis, and arranged on the first upper surface;
wherein the first roof panel further comprises a first upper edge and a first lower edge;
wherein the first attachment flange extends from the first lower surface at the first lower edge and in a direction away from the middle portion and the second roof panel and at an angle to the first lower surface that is less than 90 degrees, so that the first attachment flange is adapted to receive a fastener to secure the device to a roof;
wherein the second roof panel further comprises a second upper edge and a second lower edge; and
wherein the second attachment flange extends from the second lower surface at the second lower edge and in a direction away from the first roof panel, so that the second attachment flange is adapted to receive a fastener to secure the device to a roof.

2. The device of claim 1, further comprising a second protrusion having substantially the shape of a "T" when viewed along the longitudinal axis, and arranged on the second upper surface.

3. The device of claim 2, further comprising a third protrusion arranged on the first upper surface, the third protrusion extending at an angle toward a center of the device.

4. The device of claim 3, further comprising a fourth protrusion arranged on the second upper surface, the fourth protrusion extending at an angle toward the center of the device.

5. The device of claim 4, further comprising:
a fifth protrusion arranged on the first upper surface adjacent to the third protrusion and extending at an angle toward the center of the device; and
a sixth protrusion arranged on the second upper surface adjacent to the fourth protrusion and extending at an angle toward the center of the device.

6. The device of claim 3, wherein the third protrusion is disposed on the first upper surface between the first protrusion and the middle portion, and the fourth protrusion is disposed on the second upper surface between the second protrusion and the middle portion.

7. The device of claim 1, wherein the device is comprised of a flexible, plastic material.

8. The device of claim 7, wherein the device is formed by an extrusion process.

9. A roof valley flashing device, comprising:
a first roof panel comprising a first upper surface and a first lower surface;
a second roof panel arranged at a first angle with respect to said first panel and comprising a second upper surface and a second lower surface;
a middle portion that connects the first roof panel and the second roof panel; and
a first attachment flange extending from the first lower surface of the first roof panel;
wherein the first roof panel further comprises a first upper edge and a first lower edge; and
wherein the first attachment flange extends from the first lower surface at the first lower edge and in a direction away from the middle portion and the second roof panel and at an angle to the first lower surface that is less than 90 degrees, so that the first attachment flange is adapted to receive a fastener to secure the device to a roof; and
wherein the middle portion is shaped and the first and second roof panels are arranged such that the device has substantially the shape of a "W" when viewed along the longitudinal axis.

10. The device of claim 9, wherein each of the first and second roof panels are joined to the middle portion by a curved corner.

11. A roof valley flashing device, comprising:
a longitudinal axis,
a first roof panel comprising a first upper surface, a first lower surface, a first upper edge, and a first lower edge;
a second roof panel arranged at a first angle with respect to said first panel, and comprising a second upper surface, a second upper edge, and a second lower edge;
a middle portion connected to the first lower edge and to the second lower edge;
a first attachment flange extending from the first lower surface of the first roof panel at the first lower edge and in a direction away from the middle portion and the second roof panel, so that the first attachment flange is adapted to receive a fastener to secure the device to a roof;
a first protrusion having substantially the shape of a "T" when viewed along the longitudinal axis, and arranged on the second upper surface; and
a second protrusion having substantially the shape of a "T" when viewed along the longitudinal axis, and arranged on the second upper surface;
wherein the first protrusion is located between the first upper edge and the first lower edge of the first roof panel and the second protrusion is located between the second upper edge and the second lower edge of the second roof panel; and
wherein the middle portion is shaped and the first and second roof panels are arranged such that the device has substantially the shape of a "W" when viewed along the longitudinal axis.

12. The device of claim 11, further comprising a second attachment flange extending from a second lower surface of the second roof panel.

13. The device of claim 12, further comprising third and fourth protrusions disposed on the first upper surface between the first protrusion and the first lower edge, the third and fourth protrusions extending toward a center of the device.

14. The device of claim 13, further comprising fifth and sixth protrusions disposed on the second upper surface between the second protrusion and the second lower edge, the fifth and sixth protrusions extending toward the center of the device.

15. The device of claim 11, wherein the first attachment flange is at an angle to the first roof panel that is less than 90 degrees.

16. A roof valley flashing device, comprising:

a longitudinal axis, a first roof panel extending along the longitudinal axis and comprising a first upper surface, a first upper edge, and a first lower edge;

a second roof panel extending along the longitudinal axis and arranged at a first angle with respect to said first panel, and comprising a second upper surface, a second upper edge, and a second lower edge;

a middle portion connected to the first lower edge and to the second lower edge;

a first attachment flange extending from a first lower surface at the first lower edge of the first roof panel, and in a direction away from the middle portion and the second roof panel, so that the first attachment flange is adapted to receive a fastener to secure the device to a roof;

a second attachment flange extending from a second lower surface at the second lower edge of the second roof panel, and in a direction away from the first roof panel, so that the second attachment flange is adapted to receive a fastener to secure the device to a roof;

at least one first tab disposed on the first roof panel, extending substantially parallel to the longitudinal axis and angled toward a center of the device; and at least one second tab disposed on the second roof panel, extending substantially parallel to the longitudinal axis and angled toward the center of the device;

wherein the middle portion is shaped and the first and second roof panels are arranged such that the device has substantially the shape of a "W" when viewed along the longitudinal axis.

17. The device of claim 16, further comprising:

a first protrusion having substantially the shape of a "T" when viewed along the longitudinal axis and arranged on the second upper surface;

a second protrusion having substantially the shape of a "T" when viewed along the longitudinal axis, and arranged on the second upper surface; and wherein the first protrusion is located between the first upper edge and the first lower edge of the first roof panel and the second protrusion is located between the second upper edge and the second lower edge of the second roof panel.

18. The device of claim 16, wherein the first attachment flange is at an angle to the first roof panel that is less than 90 degrees, and the second attachment flange is at an angle to the second roof panel that is less than 90 degrees.

* * * * *